US009574380B2

(12) United States Patent
Kim

(10) Patent No.: US 9,574,380 B2
(45) Date of Patent: Feb. 21, 2017

(54) CLOSING AND OPENING APPARATUS OF LUGGAGE ROOM FOR VEHICLE

(71) Applicant: Hyundai Motor Company, Seoul (KR)

(72) Inventor: Beom Jung Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 175 days.

(21) Appl. No.: 14/535,581

(22) Filed: Nov. 7, 2014

(65) Prior Publication Data

US 2015/0337568 A1 Nov. 26, 2015

(30) Foreign Application Priority Data

May 21, 2014 (KR) ..... 10-2014-0061026

(51) Int. Cl.

| | |
|---|---|
| ***E05C 3/06*** | (2006.01) |
| ***E05B 83/18*** | (2014.01) |
| ***E05B 77/38*** | (2014.01) |
| ***E05B 85/04*** | (2014.01) |
| ***E05B 15/02*** | (2006.01) |

(52) U.S. Cl.

CPC ..... *E05B 83/18* (2013.01); *E05B 15/022* (2013.01); *E05B 77/38* (2013.01); *E05B 85/045* (2013.01); *Y10T 292/1076* (2015.04)

(58) Field of Classification Search

CPC ..... E05B 77/38; E05B 81/22; E05B 15/0006; E05B 15/0205; Y10T 292/68; Y10T 292/696; Y10T 292/688

USPC ..... 292/196, 340, 341, 341.12

See application file for complete search history.

(56) References Cited

U.S. PATENT DOCUMENTS

| | | | | |
|---|---|---|---|---|
| 6,257,632 | B1 * | 7/2001 | Jung | E05B 85/045 292/341.15 |
| 7,416,228 | B2 * | 8/2008 | Pfitzinger | E05B 15/0046 292/214 |
| 7,909,372 | B2 * | 3/2011 | Yamada | B60N 2/366 292/340 |

FOREIGN PATENT DOCUMENTS

| | | | |
|---|---|---|---|
| JP | 2000-104425 | A | 4/2000 |
| KR | 1999-005525 | U | 2/1999 |
| KR | 1999-0024591 | U | 7/1999 |
| KR | 2002-0019248 | A | 3/2002 |
| KR | 10-2003-0088775 | A | 11/2003 |
| KR | 10-2010-0025254 | A | 3/2010 |
| KR | 10-2012-0051925 | A | 5/2012 |

* cited by examiner

*Primary Examiner* — Mark Williams
(74) *Attorney, Agent, or Firm* — Morgan, Lewis & Bockius LLP

(57) ABSTRACT

An opening and closing apparatus of a luggage room for a vehicle may include a latch configured to be coupled with a luggage room door of a vehicle and provided with a locking hook, a housing configured to have a space part formed therein, a striker configured to have one portion penetrating through the housing, be provided with a locking part locked or unlocked to or from the latch, and have another portion provided with an extension extending in a left and right direction of the vehicle from a lower portion of the locking part to insert the extension into the space part of the housing, and an elastic member configured to be provided in the space part of the housing and formed to enclose an outside of the extension of the striker.

9 Claims, 5 Drawing Sheets

CLOSING AND OPENING APPARATUS OF LUGGAGE ROOM FOR VEHICLE

CROSS REFERENCE TO RELATED APPLICATION

The present application claims priority to Korean Patent Application No. 10-2014-0061026, filed May 21, 2014, the entire contents of which is incorporated herein for all purposes by this reference.

BACKGROUND OF THE INVENTION

Field of the Invention

The present invention relates to a closing and opening apparatus for a luggage room for a vehicle capable of reducing vibration and noise generated at the time of idling of a vehicle or driving of a vehicle while fixing a luggage room door to a vehicle body, by coupling or decoupling a latch formed at the luggage room door of the vehicle with or from a striker formed at the vehicle body.

Description of Related Art

As vehicle fuel efficiency is increasingly important, restrictions of idle RPM are stricter and stricter. Therefore, as a frequency band in which resonance may be structurally avoided in a vehicle body mode, a radiator mode or the like is increasingly reduced by restricting the increase in the idle RPM and the like, tuning to improve idle noise vibration harshness (NVH) performance has been increasingly difficult.

Further, by reducing the RPM in a direct connection area to improve fuel efficiency, lock-up booming of a transmission has been also worsened due to a driving system mode approach. At present, an attempt to improve booming noise by a method for mounting a damper in an opening and closing apparatus of a luggage room to improve the lock-up booming, and the like has been conducted. However, a space which may mount a latch and a striker between the luggage room door (trunk lid) and the vehicle body is narrow and thus a weight of the damper to a weight of the luggage room door is small, such that an improvement effect of the booming noise is not really large.

FIG. 1 illustrates an opening and closing apparatus of a luggage room for a vehicle according to the related art, in which a back luggage room door 20 of a vehicle is provided with a latch 30 and a vehicle body 10 is fastened with a striker 50 by a fastening member 70. The vehicle body 10 may be fastened with the striker 50 by a rigid scheme of locking a locking hook, which is provided in the latch 30 of the door 20, to a locking part 51 of the striker 50.

In more detail, the luggage room door 20 is provided with the latch 30 having the locking hook, the vehicle body 10 contacting the luggage room door 20 is provided with the striker 50 with the "n"-shaped locking part 51 to lock the locking hook of the latch 30 to the "n"-shaped locking part 51 of the striker 50, thereby preventing the luggage room door 20 from opening by vibration, impact, and the like which are generated while driving the vehicle. However, a frequency is generated by continuous displacement of the striker and the latch in an up and down direction at the time of the idling of the vehicle or while driving the vehicle.

As described above, an indoor sound of the vehicle is greatly affected by the luggage room. However, the luggage room door is fastened with the vehicle body by the rigid scheme using the latch and the striker, so that the freedom of the tuning is insufficient and it is difficult to reduce the booming noise. Further, the vehicle is excited by the resonance frequency of the vehicle at the time of the driving or idling of the vehicle and thus the booming noise of the interior of the vehicle may be increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an opening and closing apparatus of a luggage room for a vehicle capable of removing booming noise of an interior of a vehicle by vibration and the like generated at idling or driving of the vehicle by changing a method of fastening a luggage room door of the vehicle with a vehicle body.

According various aspects of the present invention, an opening and closing apparatus of a luggage room for a vehicle may include a latch configured to be coupled with a luggage room door of a vehicle and provided with a locking hook, a housing configured to have a space part formed therein, a striker configured to have one portion penetrating through the housing, be provided with a locking part locked or unlocked to or from the latch, and have another portion provided with an extension extending in a left and right direction of the vehicle from a lower portion of the locking part to insert the extension into the space part of the housing, and elastic members provided in the space part of the housing and formed to enclose an outside of the extension of the striker.

The locking part of the striker may be formed in a vertical direction and the extension may be formed in a left and right direction of a vehicle body from an end of the locking part and thus the locking part and the extension may be perpendicular to each other.

The extension of the striker may be a bar firned in a circular shape and the elastic member enclosing the outside of the extension may be a pipe shape.

The end of the locking part of the striker may be penetrably provided with a locking hole to lock a locking hook of the latch to the locking hole so as to couple the luggage room door with the vehicle body.

The elastic members may be each coupled with both sides of the extension of the striker.

Each elastic member may be provided with a hollow part indented inwardly along an inner peripheral surface thereof.

A central portion of the housing may be provided with a neck part indented downwardly and upwardly from an upper surface and a lower surface of the housing and the extension of the striker may be inserted into the neck part in a left and right direction.

The housing may be provided with fastening parts having a plate shape which extend to both sides of the housing to couple the fastening parts with the vehicle body by a fastening member.

An upper surface of the housing may be provided with a through hole to penetrate the striker through the through hole.

A stopper made of an elastic material may be provided between the housing and the locking part of the striker and may be coupled to the striker, spaced apart from the striker by a predetermined distance.

A stopper made of an elastic material may be provided between the housing and the extension of the striker and may be coupled to the striker, spaced apart from the striker by a predetermined distance.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1A:
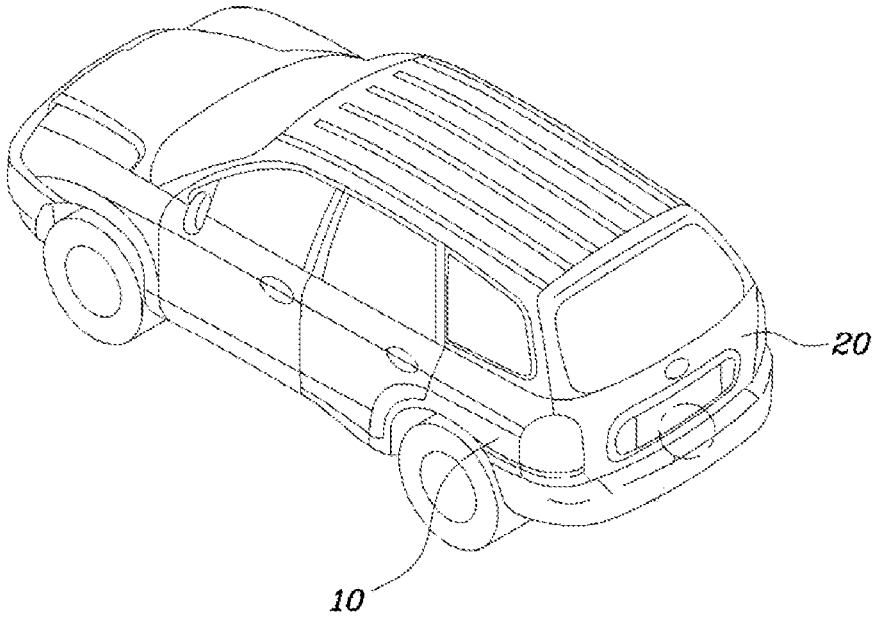
FIG. 1A (Related Art)
FIG. 1A and FIG. 1B are views of an opening and closing apparatus of a luggage room for a vehicle according to the related art.
Figure 1B:
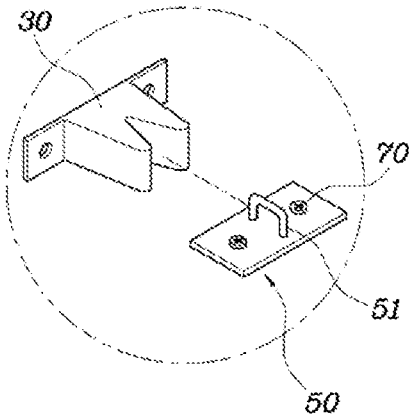
FIG. 1B (Related Art)
Figure 2A:
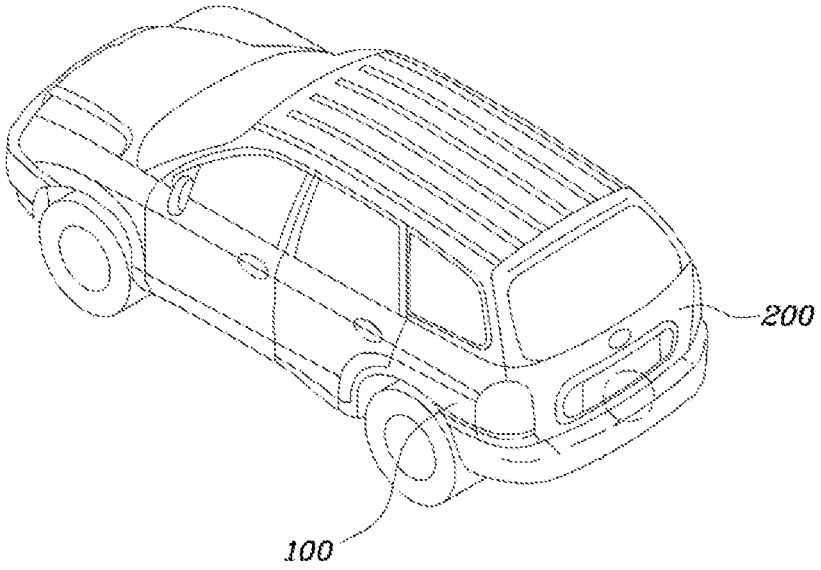
FIG. 2A and FIG. 2B are views of an exemplary opening and closing apparatus of a luggage room for a vehicle according to the present invention.
Figure 2B:
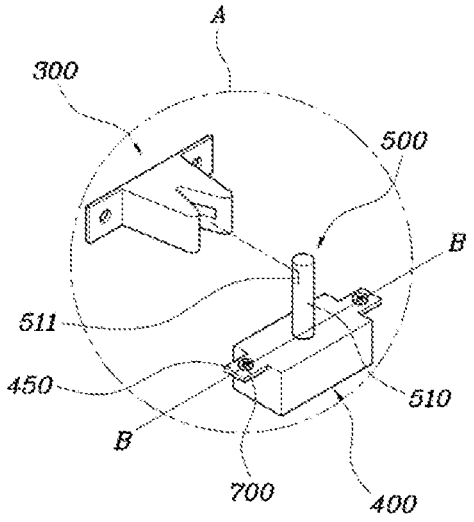
Figure 3:
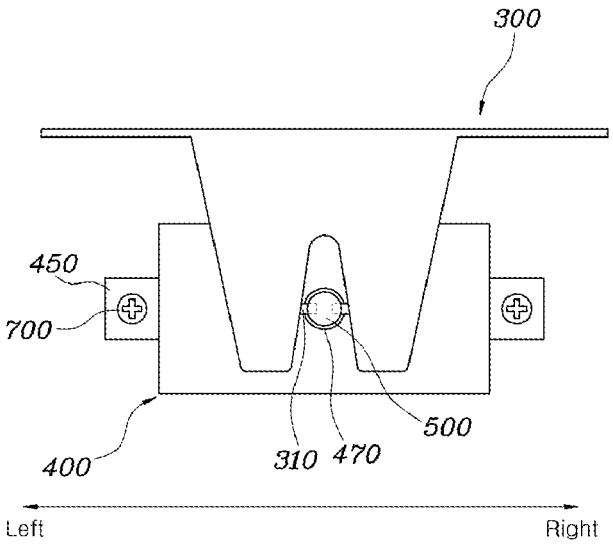
FIG. 3 is a coupled view of portion A of FIG. 2B.
Figure 4:
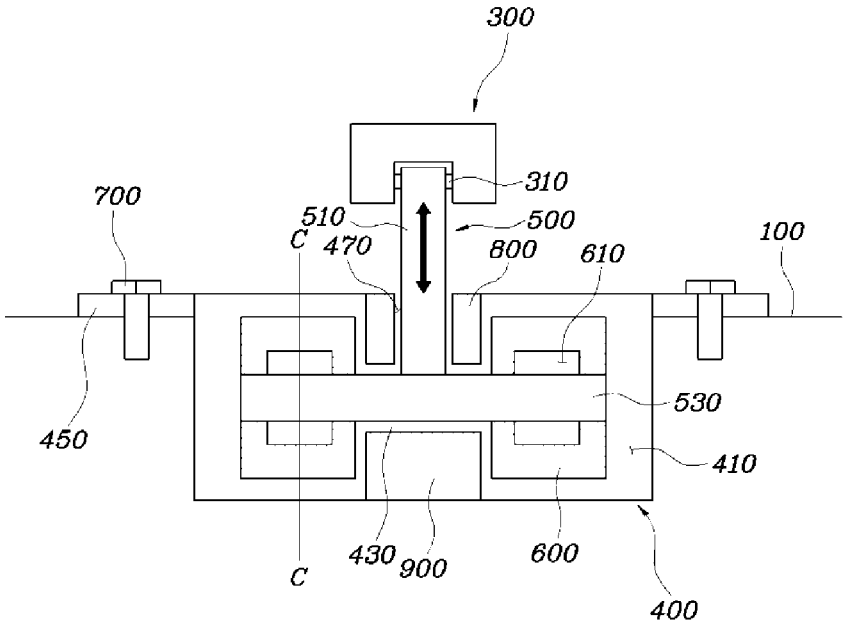
FIG. 4 is a cross-sectional view taken along the line B-B of FIG. 2B.
Figure 5:
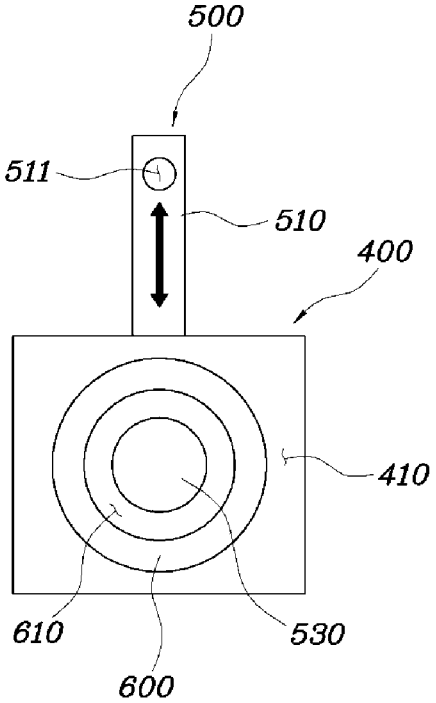
FIG. 5 is a cross-sectional view taken along the line C-C of FIG. 4.

FIGS. 2A and 2B are views of an opening and closing apparatus of a luggage room for a vehicle according to various embodiments of the present invention, FIG. 3 is a coupled view of portion A of FIG. 2B, and FIG. 4 is a cross-sectional view taken along the line B-B of FIG. 2B. Further, FIG. 5 is a cross-sectional view taken along the line C-C of FIG. 4.

An opening and closing apparatus of a luggage room for a vehicle according to various embodiments of the present invention includes a latch 300 configured to be coupled to a luggage room door 200 of a vehicle and provided with a locking hook 310, a housing 400 configured to have a space part 410 formed therein, a striker 500 configured to have one portion penetrating through the housing 400, be provided with a locking part 510 locked or unlocked to or from the latch 300, and have the other portion provided with an extension 530 extending in a left and right direction from a lower portion of the locking part 510 to insert the extension 530 into the space part 410 of the housing 400, and an elastic member 600 configured to be provided in the space part 410 of the housing 400 and formed to enclose an outside of the extension 530 of the striker 500.

Therefore, by the configuration as described above, the locking hook 310 of the latch 300 coupled with the luggage room door 200 is coupled or decoupled with or from the striker 500 coupled with the vehicle body 100, and thus the luggage room door 200 may be opened and closed. Further, the latch 300 and the striker 500 are minutely displaced in an up and down direction at the time of idling or driving of a vehicle in the state in which the latch 300 is fastened with the striker 500 and thus a specific frequency is generated. The latch 300 is rotatably provided with the locking hook 310 based on a central axis within the latch 300.

An inside of the housing 400 is provided with the predetermined space part 410 and the space part 410 is inserted with the extension 530 of the striker 500 and the elastic member 600 enclosing the outside of the extension 530.

The striker 500 includes the locking part 510 formed in the vertical direction and the extension 530 extending in a left and right direction of the vehicle body from the lower end of the locking part 510, in which the locking part 510 and the extension 530 are formed to be perpendicular to each other. That is, a side end which is provided with the locking part 510 and the extension 530 of the striker 500 may be an upside down T-letter shape (⊥). Further, both of the locking part 510 and the extension 530 may be a bar shape having a circular section or the extension 530 may be the bar shape but the locking part 510 may have any shape which may make the locking hook 310 of the latch 300 be coupled or decoupled with or from the striker 500. Therefore, a locking hole 511 is formed to penetrate through an end of the locking part 510 of the striker 500 and thus the locking hook 310 of the latch 300 is locked to the locking hole 511, such that the luggage room door 200 may be coupled with the vehicle body 100.

Further, a section of the extension 530 may be a circular bar shape, and thus the elastic member 600 enclosing the outside of the extension 530 may also be a pipe shape which has an inside longitudinally provided with a hole.

As illustrated in FIGS. 4 and 5, the elastic member 600 may be a bushing and the like which is made of an elastic material and may be coupled to the left and right sides of the extension 530, respectively. The inside of the elastic member 600 may be a pipe shape which is longitudinally hollow.

Further, if necessary, a hollow part 610 indented inwardly by a predetermined length along an inner peripheral surface of the elastic member 600 is formed and thus the elastic member 600 is more elastically formed to form a specific frequency band, thereby removing booming noise. Therefore, to show up the foregoing characteristics, the striker 500 is minutely displaced in an up and down direction of the vehicle at the time of idling or driving of the vehicle. To this end, the striker 500 is formed to be supported only by the elastic member 600.

Since each vehicle has unique masses and frequencies for each vehicle according to vibration at the time of the idling of the vehicle or while driving the vehicle, rigidity of the elastic member 600 is designed and mounted to be specified based on the unique frequency so that the elastic member 600 has a frequency which may remove the booming noise of the vehicle.

As described above, the elastic member 600 having the rigidity to have the unique frequency is mounted on the extension 530 of the striker 500 and thus the frequency generated at the time of the idling of the vehicle or while driving the vehicle is offset with the frequency generated by the elastic member 600, thereby removing the booming noise.

Further, a central portion of the housing 400 may be provided with neck parts 430 which are indented downwardly and upwardly from an upper surface and a lower surface thereof. The extension 530 of the striker 500 may be inserted into the neck part 430 in a left and right direction. Both ends of the housing 400 are provided with fastening parts 450 having a plate shape which each extend to both sides and thus the fastening part may be designed to be coupled with the vehicle body 100 by a fastening member 700. Further, according to the design, the upper surface of the housing 400 is provided with a through hole 470 and thus the locking part 510 of the striker 500 may be penetrably coupled with the through hole 470.

Stoppers 800 and 900 to prevent a motion of the luggage room door 200 by the elastic member 600 at the time of opening and closing the luggage room door 200 from increasing to a specific value or more may be coupled between the striker 500 and the housing 400. The stoppers 800 and 900 may be coupled with an upper portion or a lower portion of the housing 400 or both of the upper and lower portions of the housing 400 and may be in particular coupled with upper and lower portions of the neck part 430. The upper stopper 800 may be made of an elastic material and thus may be provided between the housing 400 and the locking part 510 of the striker 500 but provided at a point spaced apart from the locking part 510 by a predetermined distance. In particular, the upper stopper 800 may be formed to enclose an outer peripheral surface of the locking part 510 from the outside. Even in this case, a predetermined distance between the locking part 510 and the upper stopper 800 is maintained. Further, the lower stopper 900 may be made of an elastic material and thus be provided between the housing 400 and the locking part 530 of the striker 500 but may be coupled with the extension 530, spaced apart from the extension 530 by a predetermined distance.

Figure 6:
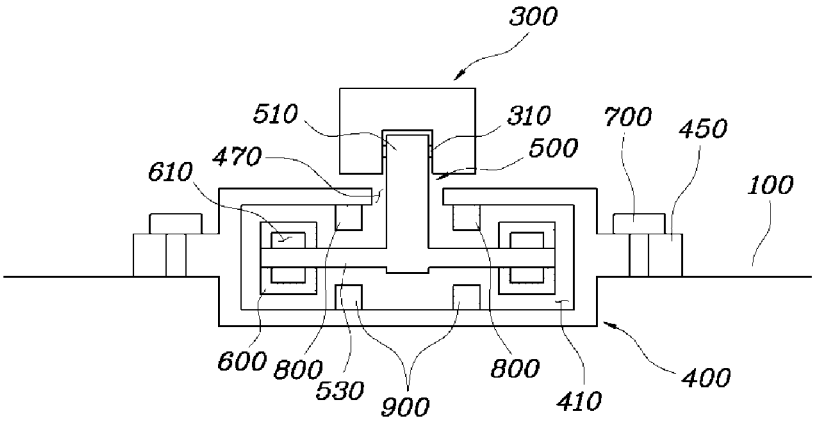
FIG. 6 is a cross-sectional view of FIG. 2B according to the present invention.

FIG. 6 is a cross-sectional view of FIG. 2B according to various embodiments of the present invention, in which the shapes of the housing 400 into which the elastic member 600 and the striker 500 are inserted, the stoppers 800 and 900, and the like may be changed without limitation according to the environment or design of the vehicle.

Figure 7:
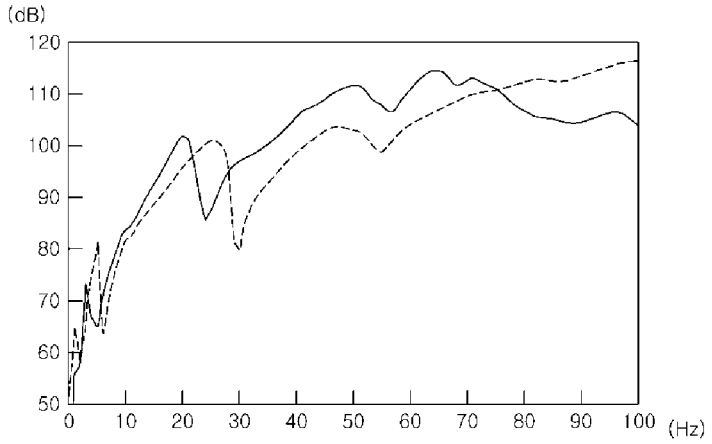
FIG. 7 is a graph illustrating comparison evaluation results of a trunk frequency response function (FRF) of the opening and closing apparatus according to the related art and of the exemplary opening and closing apparatus according the present invention.
Figure 8:
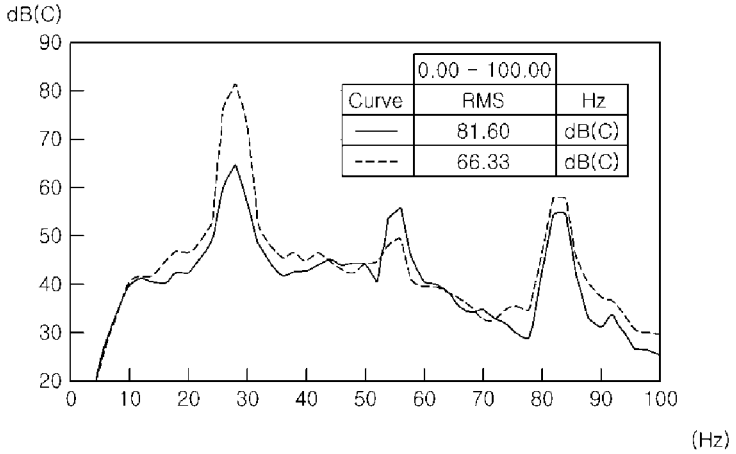
FIG. 8 is a graph illustrating evaluation results of indoor idle booming of the opening and closing apparatus according to the related art and of the exemplary opening and closing apparatus according to the present invention.

FIG. 7 is a graph illustrating comparison evaluation results of trunk frequency response function (FRF) of the opening and closing apparatus of a luggage room for a vehicle according to the related art and various embodiments of the present invention. FIG. 8 is a graph illustrating evaluation results of indoor idle booming of the opening and closing apparatus of a luggage room for a vehicle according to the related art and various embodiments of the present invention. Dotted lines of FIGS. 7 and 8 illustrate results when the opening and closing apparatus of a luggage room for a vehicle according to the related art is applied and solid lines thereof illustrate results when the opening and closing apparatus of a luggage room for a vehicle according to the exemplary embodiment of the present invention is applied.

The frequency by the displacement generation in the up and down direction of the luggage room door of the vehicle is determined by the following Equation.

$$f = \sqrt{\frac{k}{m}}$$

In the above Equation, f represents a frequency, k represents the rigidity of the elastic member 600, and m is the mass of the luggage room door 200. Therefore, the frequency of the luggage room door 200 is determined by the rigidity of the elastic member 600 since the mass of the luggage room door 200 has a unique number for each vehicle. That is, the elastic member 600 inserted into the extension 530 of the striker 500 which is coupled to the vehicle body 100 serves as the rigidity k and the weight of the luggage room door 200 itself serves as the mass m. Therefore, when the frequency at the time of the idling or driving of the vehicle body 100 is known, the frequency is offset with the frequency of the opening and closing apparatus of the luggage room for a vehicle to remove the booming noise, thereby giving more comfortable and convenient feeling to a user at the time of using the vehicle.

First, FIG. 7 illustrates the comparison results of the FRF of the luggage room, in which a horizontal axis represents a frequency Hz and a vertical axis represents a size dB of noise to represent a resonance characteristic of the luggage room when acceleration per force (m/s ^ 2)/N, that is, the same force is excited.

The various embodiments of the present invention perform an experiment as an object of the case in which the idle frequency is 20 to 30 Hz. Reviewing the graph characteristics in a range of 20 to 30 Hz of FIG. 7, when the opening and closing apparatus of the luggage room for a vehicle according to the related art is mounted, noise above 100 dB occurs, but when the opening and closing apparatus of a luggage room for a vehicle according to various embodiments of the present invention is mounted, a slab hole sharpened downwardly is formed and only noise corresponding to 85 dB is generated, such that it may be considered that a noise removal effect of 15 dB or more is generated.

Further, FIG. 8 illustrates a comparison of a size of indoor idle booming generated by the luggage room at the time of the idling of the vehicle, in which a horizontal axis represents a frequency Hz and a vertical axis represents a size dB of noise to represent a measurement result of noise which is generated by a noise level stress Pa. Similar to FIG. 7, reviewing the graph characteristics in a range of 20 to 30 Hz which is the idle frequency, when the opening and closing apparatus of a luggage room for a vehicle according to the related art is mounted, a peak point represents 81.60 dB (C) which is over 80 dB (C) but when the opening and closing apparatus of a luggage room for a vehicle according to various embodiments of the present invention is mounted, only noise corresponding to the peak point of about 66.33 dB (C) is generated and thus the improvement effect of indoor idle booming noise of 15 dB (C) or more may be shown.

According to the opening and closing apparatus of the luggage room for the vehicle, the vibration is generated at the time of the idling or driving of the vehicle or at the time of the idling of the vehicle or while driving the vehicle and the striker is minutely displaced in the up and down direction at the time of the lock-up of the transmission to generate the frequency tuned by the weight of the luggage room door and the rigidity of the elastic member and offset the tuned frequency with the frequency generated from the vehicle itself, thereby removing the booming noise.

Further, the large displacement is generated in the up and down direction at the time of opening and closing the luggage room door, but the large displacement may be controlled by the upper and lower stoppers which are coupled with each other between the housing and the striker, spaced apart from each other by the predetermined distance. Therefore, the interior noise may be reduced by removing the factors to worsen the interior booming occurring at the time of the idling or driving of the vehicle to more comfortably and conveniently provide the environment of the vehicle to the passenger, thereby increasing the customer satisfaction.

According to the opening and closing apparatus of the luggage room for the vehicle having the structure as described above, the vibration is generated at the time of the idling or driving of the vehicle or at the time of the idling of the vehicle or while driving the vehicle and the striker is minutely displaced in the up and down direction at the time of the lock-up of the transmission to generate the frequency tuned by the weight of the luggage room door and the rigidity of the elastic member and offset the tuned frequency with the frequency generated from the vehicle itself, thereby removing the booming noise.

Further, the large displacement is generated in the up and down direction at the time of opening and closing the luggage room door, but the large displacement may be controlled by the upper and lower stoppers which are coupled to each other between the housing and the striker, spaced apart from each other by the predetermined distance. Therefore, the interior noise may be reduced by removing the factors to worsen the interior booming occurring at the time of the idling or driving of the vehicle to more comfortably and conveniently provide the environment of the vehicle to the passenger, thereby increasing the customer satisfaction.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An opening and closing apparatus of a luggage room for a vehicle, the opening and closing apparatus comprising:

a latch configured to be coupled with a luggage room door of the vehicle wherein the latch is provided with a locking hook;

a housing configured to have a space formed therein;

a striker having a first portion and a second portion, wherein the first portion is configured to penetrate through the housing, and is provided with a locking part selectively locked to the latch, and wherein the second portion is provided with an extension extending in a predetermined direction of the vehicle from a lower portion of the locking part and the extension is inserted into the space of the housing; and elastic members provided in the space of the housing and formed to enclose an outside of the extension of the striker, wherein a first stopper made of an elastic material is provided between the housing and the locking part of the striker, coupled to the housing, and spaced apart from the striker by a predetermined distance, and wherein a second stopper made of an elastic material is provided between the housing and the extension of the striker, coupled to the housing, and spaced apart from the striker by a predetermined distance.

2. The opening and closing apparatus of claim 1, wherein the locking part of the striker is formed in a vertical direction and the extension is formed in a predetermined direction of a vehicle body from an end of the locking part and the locking part and the extension are perpendicular to each other.

3. The opening and closing apparatus of claim 1, wherein the extension of the striker is a bar and the elastic member enclosing the outside of the extension is a pipe shape.

4. The opening and closing apparatus of claim 1, wherein an end of the locking part of the striker is penetrably provided with a locking hole to lock the locking hook of the latch to the locking hole so as to couple the luggage room door with a vehicle body.

5. The opening and closing apparatus of claim 1, wherein the elastic members are each coupled to both sides of the extension of the striker.

6. The opening and closing apparatus of claim 1, wherein each of elastic members is provided with a hollow part indented inwardly along an inner peripheral surface thereof.

7. The opening and closing apparatus of claim 1, wherein a central portion of the housing is provided with a neck part indented downwardly and upwardly from an upper surface and a lower surface of the housing and the extension of the striker is inserted into the neck part in a horizontal direction.

8. The opening and closing apparatus of claim 1, wherein the housing is provided with fastening parts having a plate shape which extend to both sides of the housing to couple the fastening parts with the vehicle body by a fastening member.

9. The opening and closing apparatus of claim 1, wherein an upper surface of the housing is provided with a through hole to penetrate the striker through the through hole.

* * * * *